United States Patent [19]

Maguire, III

[11] Patent Number: 4,955,373

[45] Date of Patent: Sep. 11, 1990

[54] AIR BREATHING ASSEMBLY AND AIR FILTER ATTACHMENT THEREIN

[76] Inventor: John N. Maguire, III, 149 Cabana Rd., Myrtle Beach, S.C. 29572

[21] Appl. No.: 421,970

[22] Filed: Oct. 16, 1989

[51] Int. Cl.[5] ..... A62B 7/10

[52] U.S. Cl. ..... 128/205.27; 128/207.16; 55/502

[58] Field of Search ..... 128/202.13, 204.28, 128/201.25, 205.12, 205.13, 205.14, 205.16, 205.17, 206.27, 200.28, 207.16, 202.27, 202.23, 387, 205.27; 55/490, 497, 502

[56] References Cited

U.S. PATENT DOCUMENTS

| | | | |
|---|---|---|---|
| 465,093 | 12/1891 | Erikson | 128/387 |
| 1,359,631 | 11/1920 | Teed | 128/207.12 |
| 1,454,645 | 5/1923 | Koehler | 128/207.12 |
| 1,929,343 | 10/1933 | Belloni | 128/201.25 |
| 3,070,089 | 12/1962 | Dick | 128/205.12 |
| 3,202,150 | 8/1965 | Miller | 128/205.12 |
| 4,154,235 | 5/1979 | Warncke | 128/201.25 |
| 4,233,972 | 11/1980 | Hauff et al. | 128/205.12 |
| 4,419,110 | 12/1983 | Ansite et al. | 128/201.25 |
| 4,452,240 | 6/1984 | Moretti | 128/201.26 |
| 4,590,951 | 5/1986 | O'Connor | 128/201.25 |

*Primary Examiner*—Eugene H. Eickholt
*Attorney, Agent, or Firm*—Oltman and Flynn

[57] ABSTRACT

An attachment for an air filter enabling it to be worn at a convenient location on a person's clothing. The attachment has a fitting for attachment to the filter which provides a passageway for the filtered air, a hose having a main air passage extending up from the fitting to a breathing device and a branch passage between the breathing device and ambient air, and a check valve arrangement which closes the branch passage when the user is drawing in filtered air and opens the branch passage when the user expels air through the breathing device. The fitting has a safety pin for attaching it and the air filter to the user's clothing.

7 Claims, 1 Drawing Sheet

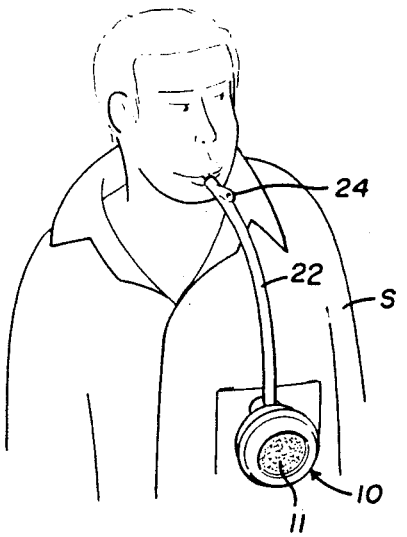
FIG. 1
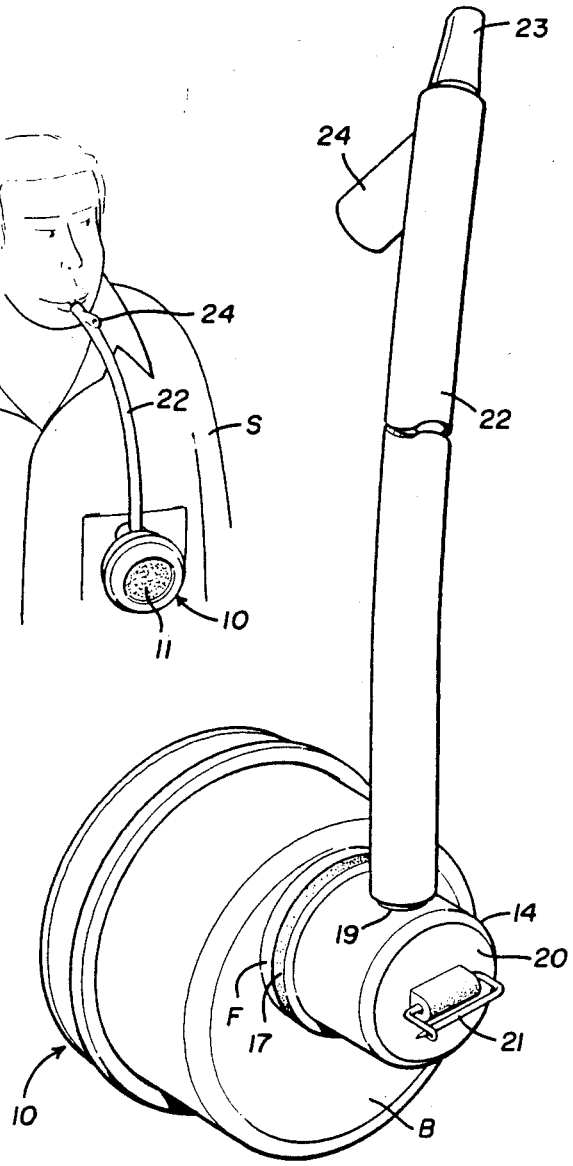
FIG. 2
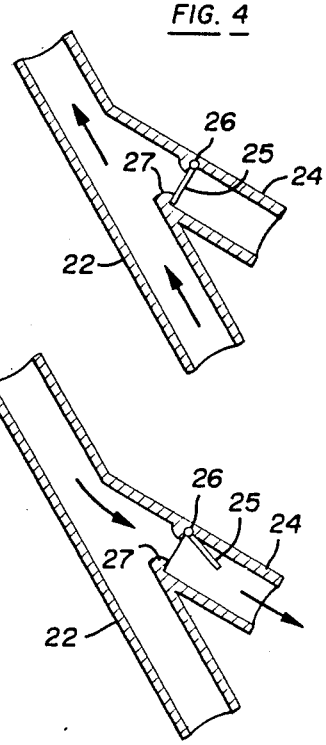
FIG. 4
FIG. 5
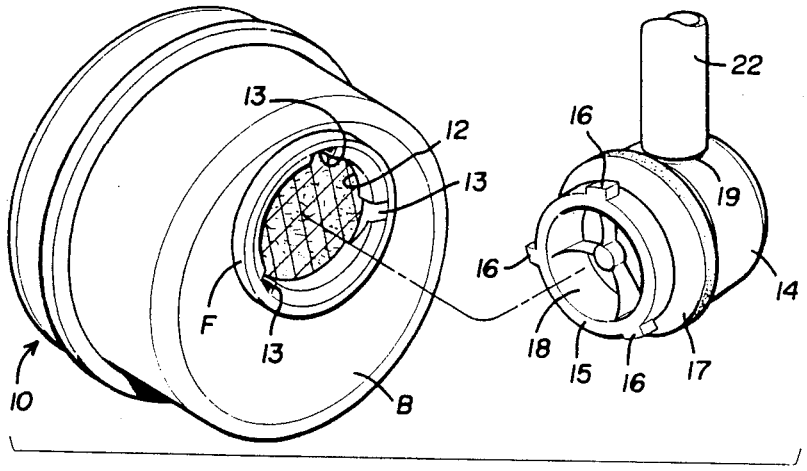
FIG. 3

AIR BREATHING ASSEMBLY AND AIR FILTER ATTACHMENT THEREIN

SUMMARY OF THE INVENTION

This invention relates to an air filter attachment and to an air breathing assembly made up of this attachment and an air filter of known design.

Various air filters have been designed for use in a mask the user wears on his or her head. These air filters typically filter out pesticides, gasoline and diesel fumes, cigarette smoke and the heavy metals it contains (e.g., lead and cadmium), radon and other impurities.

The present invention enables such an air filter to be worn on a person's clothing with a hose extending up to a breathing device in the form of a mouthpiece, mouth mask or nose mask through which the person draws in filtered air. Preferably, the hose has a main passageway connecting the filter to the breathing device and a branch passageway connecting the breathing device to the ambient air. Preferably, also, the hose has a check valve arrangement which blocks the branch passageway when the person is drawing is filtered air through the main passageway and opens the branch passageway when the person is expelling air. In accordance with the present invention, the lower end of the hose is connected to a fitting that is manually connectable to and detachable from the air filter and, when connected to the air filter, provides an air passageway from the filter to the hose.

In accordance with the present invention, the air filter is worn on the user's clothing so as to be inconspicuous and more socially acceptable than if worn directly over the user's face.

A principal object of this invention is to provide a novel air filter attachment which enables a person to draw in filtered air from an air filter worn conveniently and inconspicuously on his or her clothing.

Another object of this invention is to provide such an air filter attachment which enables the user to expel filtered air directly from his or her mouth to the atmosphere through the attachment.

Another principal object of this invention is to provide a novel air breathing assembly having an air filter worn on the user's clothing and an attachment to that filter for passing filtered air up to a breathing device, such as a mouthpiece, mouth mask or nose mask.

Further objects and advantages of this invention will be apparent from the following detailed description of a presently preferred embodiment which is illustrated schematically in the accompanying drawings.

DESCRIPTION OF THE DRAWING

FIG. 1 is a front view of a person using the present attachment on an air filter in accordance with the present invention;

FIG. 2 is a rear perspective view of the present attachment connected to the back of an air filter of known design;

FIG. 3 is an exploded perspective view showing the fitting on the lower end of the present attachment separated from the air filter to which it is attached when the invention is in use;

FIG. 4 is a fragmentary longitudinal section through the hose in the present air filter attachment showing its check valve closed when the user is drawing air in through the filter; and FIG. 5 is a similar view showing the check valve opened by the pressure of air exhaled from the user's mouth.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Element 10 in FIGS. 1, 2 and 3 is an air filter of known design which has been used on face masks. As shown in FIG. 1, this filter has a screen 11 on the front. As shown in FIG. 3, the filter 10 has a flat, relatively thin, back wall B with a rearwardly projecting annular flange F, encircling an opening 12 that has three circumferentially spaced bayonet slots 13 along its edge.

In accordance with the present invention, a hollow, generally cup shaped fitting 14 is releasably attachable to the back wall flange F of filter 10. As sen in FIG. 3, this fitting has a forwardly projecting, cylindrical neck 15 which is slidably insertable into and removable from the opening 12. This neck has three outwardly projecting tabs 16 for slidable insertion into the slots 13, after which the filter 10 may be turned on fitting 14 to lock the fitting tabs 16 in the slots 13. Fitting 14 has an annular sealing gasket 17 of rubber like material encircling its neck 15 behind the tabs 16 and sealingly engageable in substantially air tight fashion with the rear face of the back wall flange F. Fitting 14 has an air passage 18 (FIG. 3) extending through its front neck 15 and up through a tubular projection 19 on top of the fitting. As shown in FIG. 2, fitting 14 has a flat back wall 20 on which a safety pin 21 of known design is rigidly mounted. This safety pin enables the fitting 14 and the attached filter 10 to be releasably fastened to the front of a garment worn by the user, such as on the pocket of a shirt S in FIG. 1.

A flexible hose 22 (FIG. 2) extends up from the fitting 14 to a mouthpiece 23. The lower end of this hose has a tight sliding fit over the tubular projection 19 on the top of the fitting. As shown in FIGS. 4 and 5, near its upper end the hose 22 has a short branch arm 24 whose upper end is joined to the main body of the hose and whose lower end is open to the atmosphere. Thus, arm 24 provides a branch passage for passing air from mouthpiece 23 to the ambient air. A flap valve number 25 is pivoted at 26 inside to the branch arm 24. Pivot 26 is on the front of en annular projection 27 on the inside of the branch arm 24 of the hose. This projection presents a flat face which provides a valve seat against which the flap valve member can seat.

In the use of this apparatus, when the user has the mouthpiece 23 in his or her mouth and draws air in, the air pressure inside the hose 22 becomes less than atmospheric pressure, causing the flap valve member 25 to seat against the flat face of projection 27, as shown in FIG. 4, and prevent air from flowing up through the branch arm 24 of the hose up to the mouthpiece. Therefore, all the air drawn into the user's mouth passes through the filter 10, as indicated by the arrows in FIG. 4.

When the user exhales through the mouthpiece 23, the air pressure inside hose 22 becomes greater than atmospheric pressure, causing the flap valve member 25 to pivot to an unseated position (FIG. 5) so that air is expelled through the open lower end of branch arm 24 of the hose, as indicated by the arrows in FIG. 5.

Instead of the flap valve arrangement shown, the hose may have two normally closed check valves, one located in the branch arm 24 and arranged to open when the pressure in the hose exceeds atmospheric pressure, and the other located in the main part of the hose below the branch arm and arranged to open when the pressure in the hose above it is below atmospheric pressure.

For use with a filter different from the one shown in the drawing, the fitting 14 may differ in structural details from the one shown so as to be readily attachable to and detachable from the particular filter used.

Also, if desired, the branch arm 24 and any check valve arrangement may be omitted from the hose 22 so that the user will expel air through the air filter 10 as well as drawing in air through it.

Preferably, the fitting 14, hose 22 and mouthpiece 23 of the present attachment could be in designer colors for esthetic reasons.

If desired, a mouth mask or a nose mask of known design could be used on the upper end of hose 22 as the breathing device in place of the mouthpiece 23.

I claim:

1. An air filter attachment comprising:

a fitting having attachment means thereon for manually connectable and releasable attachment to an air filter in substantially air-tight fashion, said fitting having an air passageway therein for passing air from the filter;

fastener means on said fitting for manually connectable and releasable attachment to a person's clothing;

a hose extending up from said fitting and communicating with said air passageway on the fitting;

and a breathing device on the upper end of said hose;

said attachment means on said fitting bring an annular neck for slidable reception in a complementary opening in the air filter, said neck having outwardly projecting tabs thereon for engagement with the air filter at said opening therein;

and said fitting having an annular sealing gasket thereon extending around said neck and sealingly engageable with the air filter behind said opening therein.

2. An air filter attachment according to claim 1 wherein said fitting has a tubular projection on the top for tight reception in the lower end of said hose.

3. An air filter attachment according to claim 2 wherein said fastener means is a safety pin.

4. An air filter attachment according to claim 2 wherein:

said hose has a main air passageway therein connecting said tubular projection on the top of said fitting to the breathing device to pass filtered air from said filter to said breathing device and a branch passageway connecting said breathing device to the atmosphere;

and further comprising:

check valve means in said hose operatively arranged (a) to close said branch passageway and open said main passageway when the person draws air in through said breathing device and (b) to open said branch passageway when the person expels air through said breathing device.

5. An air filter attachment according to claim 4 wherein said fastener means is a safety pin.

6. An air filter attachment according to claim 1 wherein:

said hose has a main air passageway therein connecting said fitting to the breathing device to pass filtered air from said filter to said breathing device and a branch passageway connecting said breathing device to the atmosphere;

and further comprising:

check valve means in said hose operatively arranged (a) to close said branch passageway and open said main passageway when the person draws air in through said breathing device and (b) to open said branch passageway when the person expels air through said breathing device.

7. An air filter attachment according to claim 6 wherein said fastener means is a safety pin.

* * * * *